US005871090A

United States Patent [19]

Doucette et al.

[11] Patent Number: 5,871,090

[45] Date of Patent: Feb. 16, 1999

[54] CARRIER TRAY AND BLANK THEREOF

[75] Inventors: Daniel E. Doucette; Mark R. Rothwell; Gary G. Winchester, all of Madison, Wis.

[73] Assignee: Kraft Foods, Inc., Northfield, Ill.

[21] Appl. No.: 672,178

[22] Filed: Jun. 26, 1996

[51] Int. Cl.[6] ..... B65D 75/00

[52] U.S. Cl. ..... 206/170; 206/198; 206/497; 294/87.2

[58] Field of Search ..... 206/497, 141, 206/162, 165, 170, 198, 427; 294/87.2, 32

[56] References Cited

U.S. PATENT DOCUMENTS

| | | | |
|---|---|---|---|
| 446,190 | 2/1891 | Post | 206/162 |
| 2,331,312 | 10/1943 | Dorfman | 206/198 |
| 2,821,299 | 1/1958 | Crary | 206/162 |
| 3,143,210 | 8/1964 | Heydon | 206/162 |
| 3,387,702 | 6/1968 | Reynolds et al. | 206/162 |
| 3,491,878 | 1/1970 | Britton et al. | 206/162 |
| 4,207,978 | 6/1980 | Patterson et al. | 206/198 |
| 5,467,870 | 11/1995 | Broskow et al. | 206/162 |
| 5,484,053 | 1/1996 | Harris | 206/162 |
| 5,501,335 | 3/1996 | Harris | 206/162 |

*Primary Examiner*—Paul Sewell
*Assistant Examiner*—Nhan T. Lam
*Attorney, Agent, or Firm*—Lockwood, Alex, Fitzgibbon & Cummings

[57] ABSTRACT

A carrier tray assembly is provided for compactly supporting a plurality of individual items, such as packaged food products. The carrier tray assembly has an inverted T-shaped configuration and a handle and also includes a member for releasably securing a plurality of these individual items together and directly or indirectly to the carrier tray. A blank is also provided which forms the carrier tray upon assembly.

11 Claims, 2 Drawing Sheets

CARRIER TRAY AND BLANK THEREOF

BACKGROUND AND DESCRIPTION OF THE INVENTION

This invention generally relates to a carrier tray which compactly supports a plurality of individual items. The invention also generally relates to a blank for forming such a carrier tray. More particularly, the invention embodies a carrier tray which is generally T-shaped so as to provide opposing shelf portions extending in opposite directions from a spine panel. A plurality of items such as food packages can be supported upon opposite sides of the spine panel in conjunction with securement means in order to provide a compact and easy-to-carry bundle of items. The carrier tray only minimally obscures from view the items which are thereby supported by the carrier tray.

Many consumer items are packaged in individual cartons which have an overall generally rectilinear shape. At times, a consumer may wish to purchase more than one of these packaged items at the same time. On some occasions, the manufacturer of the item will wish to offer a discount for purchasing same in multiple quantities. Both objectives are addressed by packaging approaches that simply provide a larger volume of items in a single package in order to thereby reap the benefits of economies of scale for both the seller and the purchaser. This larger volume approach, however, is not particularly satisfactory in instances where the item sought to be marketed in a larger quantity arrangement is not conveniently scaled up by simply increasing the volume in a package.

In some instances, simply providing a package of larger volume in order to scale up the product being sold can be undesirable. For example, this necessitates the manufacturing of differently sized packages, thereby increasing overall costs and causing inventory complications. In other instances, the particular item being marketed is in effect defined by a given size consideration. One example in this regard is when the item is a packaged meal for an individual. A more specific example is a pre-packaged meal which is intended to be transported as a unit such as from home to school or work. For these types of products, economies of scale can be realized only by further packaging the individual items or products in a way that each meal, for example, remains individually packaged, but a plurality of them are sold as a unit.

Accordingly, it is at times desirable to bundle together multiple items for sale as a unit, whether those items are intended for a single use application such as a meal or whether the bundling is done in order to avoid having to produce a large-sized version of a particular product. A typical approach for achieving this bundling can be to put up a package which is in form of a carton that contains a plurality of these items.

The present invention eliminates certain disadvantages of this traditional cartoning approach. It uses much less material than does the traditional carton. It avoids the situation where graphics and other informational and promotional information is hidden from view by being within an outer carton. It minimizes the need, if any, to provide product identifiers on an outer carton. The approach in accordance with the present invention also reduces inventory requirements by eliminating outer cartons which must be specifically sized in order to accommodate properly the individual items or packages to be bundled by the carton.

In accordance with the present invention, a carrier tray and blank from which the carrier tray is formed have been found to successfully address these shortcomings of traditional multiple-package cartoning while also avoiding certain difficulties which can arise with certain individual item packages such as damage to the packaging during transport handling and stacking and during pick up and carrying by the consumer.

In summary, the present invention takes the form of a carrier tray which compactly supports a plurality of individual items, such as packaged meals and the like, the carrier tray having a generally vertically oriented spine panel, a generally horizontally oriented bottom panel, one or more members or features for releasably securing a plurality of the individual items to the spine panel, and a handle member which projects beyond the bundled individual items during carrying. The blank for forming the carrier tray incorporates a plurality of panels of selected sizing and orientation which, when folded, define such a carrier tray.

It is accordingly a general object of the present invention to provide an improved carrier tray and blank from which the carrier tray is formed.

Another object of the present invention is to provide an improved carrier tray and blank which conserves material when compared with traditional cartoning approaches.

Another object of the present invention is to provide an improved carrier tray and blank for bundling a plurality of packaged items in a form having a carrying handle.

Another object of this invention is to provide an improved carrier tray and blank for bundling and supporting a plurality of packaged items having windows and which minimizes the likelihood of damage to the windows while picking up and carrying the package.

Another object of the present invention is to provide an improved carrier tray and blank therefor which features enhanced visibility of individual items which are bundled.

Another object of the present invention is to provide an improved carrier tray and blank which provides for substantially flat and secure stacking of bundles of packaged items.

Another object of the present invention is to provide an improved bundling approach which minimizes the extent of printing or other product identifying information on the bundling device.

Another object of this invention is to provide an improved carrier tray and blank for forming same which can be used with bundles of packages of different sizes which are generally close in size and shape.

These and other objects, advantages and features of the present invention will be apparent from and clearly understood through a consideration of the following detailed description.

BRIEF DESCRIPTION OF THE DRAWINGS

In the course of this description, reference will be made to the attached drawings, wherein.

DETAILED DESCRIPTION OF THE INVENTION

Figure 1:
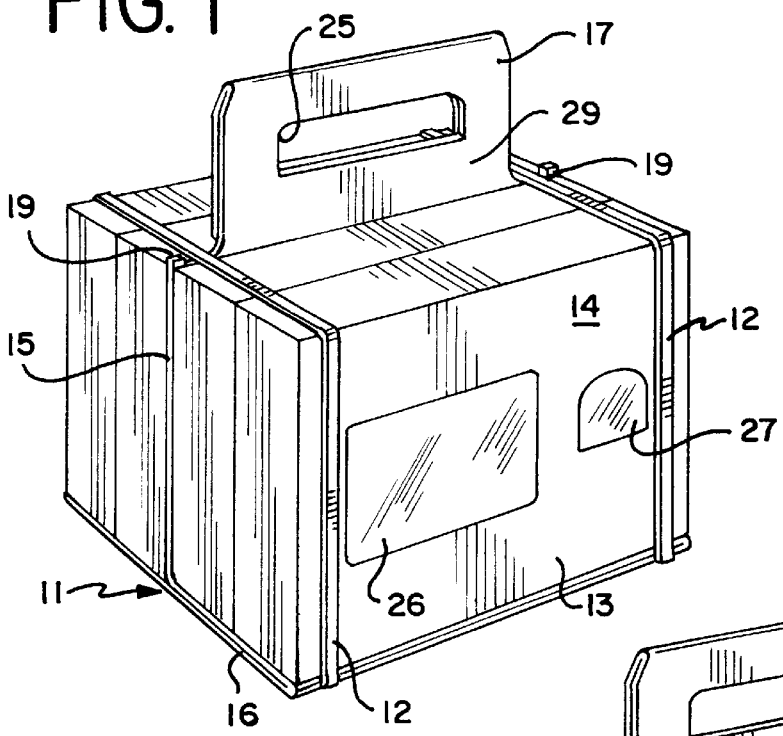
FIG. 1 is a perspective view of a plurality of individual packages that are bundled together with a carrier tray assembly in accordance with the present invention.

A typical carrier tray assembly in accordance with the present invention is illustrated in FIG. 1. Included is a carrier tray, generally designated at 11, and a plurality of securing members 12. The illustrated bundle includes a plurality of individual items 13, which in the illustrated situation are packaged meals. It will be noted that the carrier tray assembly obscures very little of the surface of the individual items 13. For example, in the arrangement shown, the front surface 14 of one of the items is almost entirely visible, as are its side ends and top end. If the bundle is properly arranged, the rear surface of a different item 13 (the rear most one as shown in FIG. 1) will also be substantially fully visible. Depending upon the sizing of the carrier tray, all or a portion of a bottom end of one or more of the items 13 also can be visible, although this is not the case in the FIG. 1 illustration.

Figure 2:
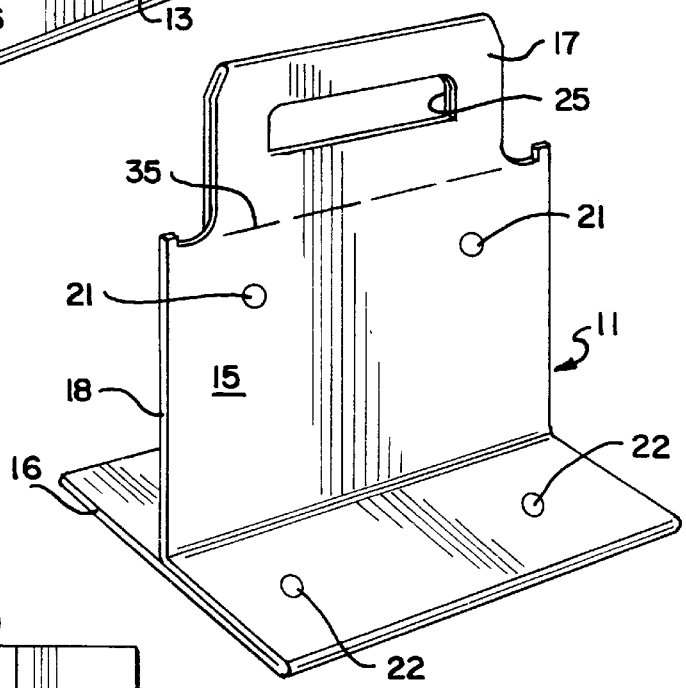
FIG. 2 is a perspective view of the carrier tray illustrated in FIG. 1.

With more particular reference to the illustrated carrier tray 11, a main or spine panel 15 is generally upstanding or vertically oriented as illustrated in FIG. 2. While a solid panel is shown, it will be appreciated that holes or slots could be included for conserving on weight and materials. Individual items 13 will butt against opposing surfaces of the spine panel 15 in forming the bundle. Bottom support for at least the inside most ones of the individual items 13 is provided by a secondary or bottom panel 16 of the carrier tray. Bottom panel 16 is generally horizontally oriented as illustrated in the drawings, and it is secured to or depends from the spine panel 15. As illustrated, the spine panel and bottom panel are typically perpendicular to each other.

A handle member was also provided in order to facilitate transport of the assembled bundle. In the illustrated embodiment, a handle member 17 is an extension of the spine panel 15. In the illustrated embodiment, this handle member is at a location generally above the spine panel. It will be understood that, for example, a handle member could instead be provided along one of the side edges 18 of the spine panel. Also, handles which are not integrally formed with the carrier tray could be used.

The arrangement illustrated in the drawings could be characterized as a T-tray which, when in use, has the overall configuration of an inverted letter T. When two or more of the individual items 13 are properly positioned within the T of the carrier tray, means are provided for securing individual items to the carrier tray. This could include or take the form of one or more adhesive areas 21, 22 which secure the individual item to the carrier tray in order to provide means for releasably securing the bundle together. Alternatively or additionally, the securing members 12 can be provided as the means for releasably securing the bundle together.

In the aspect of the invention that is illustrated in FIG. 1, securing members 12 take the form of two straps or bands, each of which encircles the bundle along a generally vertical orientation which is transverse to the spine panel 15. In the FIG. 1 embodiment, the bands also encircle the bottom panel 16. With this arrangement, the bands 12 can conveniently be located between the handle member and projections 19 from the spine panel 15. This can provide a stop to retard sliding of the bands off of either side of the bundle.

Figure 3:
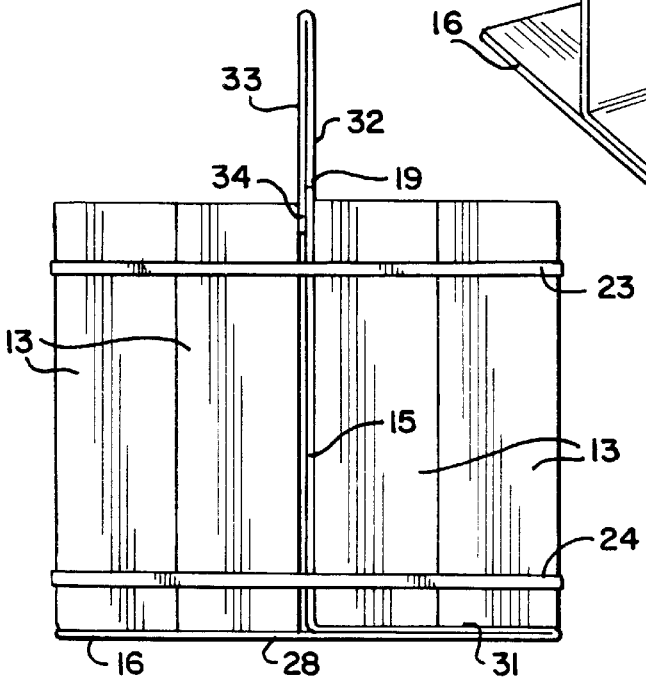
FIG. 3 is an end view of an assembly similar to that depicted in FIG. 1.

In the embodiment shown in FIG. 3, a band 23 encircles and assembles the bundle along a generally horizontal orientation. A second band 24 is also illustrated in FIG. 3. While two bands are shown, one band is typically sufficient. When using strapping having this orientation of the bands, the assembly is, in effect, one of attaching the individual items 13 to the spine panel 15.

Other embodiments, not explicitly illustrated, include narrow bands, wide sleeves, full length sleeves and excess length sleeves of shrinkable or stretchable material. Included are materials such as saran and other materials which shrink when passed through a heat tunnel or the like. When an excess length sleeve, shrinking will occur over the edges and corners.

It will be appreciated that, with the overall bundle arrangement in accordance with the invention, the plurality of individual items 13 are picked up as a unit, such as by placing the hand through opening 25 of the handle member 17. This minimizes the chance that the person handling the individual items will grasp them by portions that are capable of damage, such as illustrated windows 26, 27. Such windows might themselves be covered with a transparent film such as cellophane, or they may be simply openings through the package panelling and beneath which are positioned items that can be damaged, such as hermetically sealed wrapping films. Provision of the handle member 17 minimizes the chance that a finger or hand will enter a window and cause damage to the product, such as when a consumer would use a window as a "handle".

It will also be noted that, with the carrier tray assembly, limited surfaces are available for adding indicia such as labels, product identifiers, instructions, UPC bar code printings and the like. Areas suitable in this regard include the bottom surface 28 of the bottom panel 16 and either face of the handle member 17, such as at 29.

Referring now to the particular structure of the illustrated carrier tray 11, same conveniently can be made of a single blank or piece of panel board. In this illustrated arrangement, the bottom panel is formed by folding the panel board onto itself and then again in an opposite direction in order to form the general T-shape. Thus, the bottom panel 16 includes a doubled-up area at the location of an intermediate panel 31. Preferably, an adhesive or other securement means will attach the respective facing surfaces of panels 16 and 31 to maintain the T-shape during assembly and thereafter.

Also as illustrated, the handle member has a double-wall construction as shown in FIG. 3. This includes a first wall 32 and a second wall 33. In the illustrated embodiment, second wall 33 includes a tab portion 34 which is secured, such as by an adhesive, to the spine panel 15. In addition, a fold line 35, which can take the form of a score line and/or perforations, is provided in order to allow for non-damaging folding of the handle member 17 such that same will lie substantially flat across a surface portion of the bundle. This feature facilitates stacking of the bundles in a suitable squared-up fashion.

Figure 4:
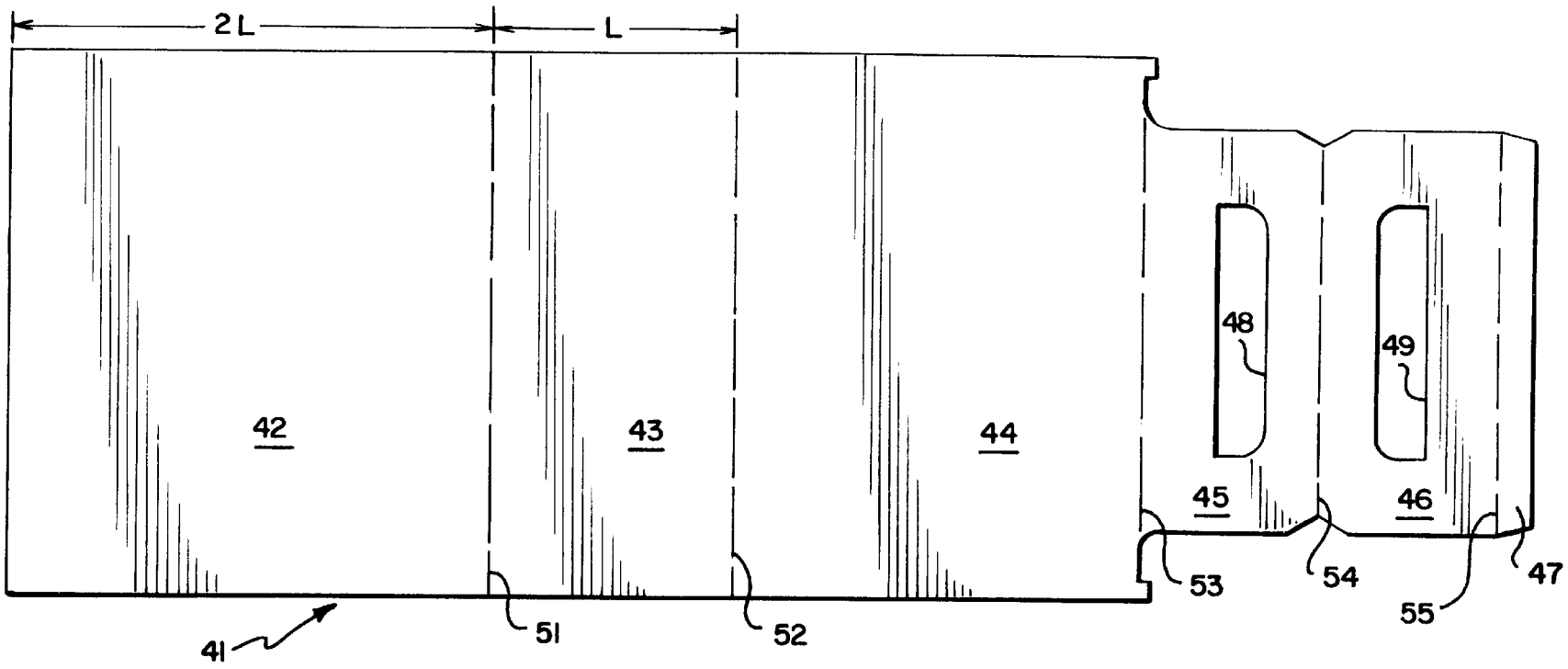
FIG. 4 is a plan view of the blank from which the carrier tray of FIG. 2 can be formed.

Referring now to FIG. 4, a blank, generally designated as 41, is shown for forming the preferred carrier tray which is illustrated. The blank includes a bottom panel portion 42, an intermediate panel portion 43, a spine panel portion 44, a first handle portion 45, a second handle portion 46, and a tab portion 47. Preferably, each such panel portion or portion is separated from adjacent portion or portions of the blank by a fold line such as a score or perforations. Illustrated fold lines are identified at 51, 52, 53, 54 and 55. In addition, each handle portion has complementary die cuts or openings 48, 49.

Spine panel portion 44 can have dimensions which generally equate to corresponding dimensions of a major face of the individual items being bundled. For example, its length, which is defined between fold lines 52 and 53, can generally correspond to the height of a package being bundled, while its width can generally correspond to the length of that package. When it is desired to have the bottom panel 16 substantially cover the entirety of the bottom portions of all of the items in the bundle, the length 2L of the bottom panel portion 42, which is defined between fold lines 51 and the end of the blank 41, will be a multiple of the width of the bottom of each package or other item making up the bundle.

Whether or not the entirety of the bottom surfaces of the individual packages or other items are to be covered by the bottom panel of the carrier tray, the intermediate panel portion 43 typically will have length L which is approximately twice the length 2L of the bottom panel portion 42. This relationship will vary if there is a desire to have one portion of the bottom panel be longer than its other portion, these portions being on opposite sides of the spine panel.

While four-carton bundles are illustrated, bundles having other numbers of cartons or packages or other items can be assembled. It is generally desirable, assuming that similar items are being bundled, that even numbers of items be bundled together. It can be useful to include adhesive areas to tack together adjacent cartons, packages or the like.

The materials out of which the blank and carrier tray can be manufactured will typically be a paperboard or a corrugated board, whether bleached or unbleached. It is important that the material used exhibit suitable tear resistance. Wall thicknesses should typically be at least about 16 point (approximately 0.2 inch or about 0.5 mm), typically at or above 26 point (about 0.4 inch or about 1 mm). The material should be suitable for acting as a centerpiece which is pinched or squeezed between adjacent items of the bundle by pressure exerted by the straps, for example. Such straps will typically be made of a polymeric material, although cellulosic straps are also possible. The materials can vary in strength and resiliency, depending upon the weight of the items being bundled together. Included are transparent strips, sleeves and overwraps, such as saran, shrink wrap materials and stretch wrap materials. When adhesive areas are provided, they can take the form of various glues and adhesives, including hot melt adhesives, or can take the form of double-sided tape.

It will be understood that the embodiments of the present invention which have been described are illustrative of some of the applications of the principles of the present invention. Various modifications may be made by those skilled in the art without departing from the true spirit and scope of the invention.

We claim:

1. A carrier tray assembly which compactly supports a plurality of individual items into a bundle, comprising:

a plurality of individual items which are packaged products for retail sale;

a vertically oriented spine panel positioned between at least two of said individual items;

a horizontally oriented bottom panel depending from and perpendicular to said spine panel, wherein said spine panel and bottom panel combine to form a T-shaped unit having generally opposing right-angled carrier shelves, each of which receives at least one of said individual items in forming said bundle;

a handle member extending from said spine panel at a location generally above said spine panel;

a plurality of bands which releasably secure said plurality of individual items into a bundle of items, which bundle is thereby secured to said spine panel, one said band being on one side of said handle member and another said band being on another side of said handle member; and an upstanding projection on each edge portion of the spine panel and a passageway defined between said handle member and each said upstanding projection, and one of said bands passes through one said passage while another of said bands passes through another said passage.

2. The carrier tray assembly in accordance with claim 1, wherein said bands each lie along a vertical plane which is perpendicular to said spine panel and which is perpendicular to said bottom panel.

3. The carrier tray assembly in accordance with claim 1, wherein said plurality of bands are generally narrow bands.

4. The carrier tray assembly in accordance with claim 1, further including an adhesive area joining said spine panel and at least one of said individual items.

5. The carrier tray assembly in accordance with claim 1, further including at least two adhesive areas securing said spine panel to at least two of said individual items.

6. The carrier tray assembly in accordance with claim 1, wherein said packaged products include edible components comprising a single meal.

7. A carrier tray assembly which compactly supports a plurality of individual items into a bundle, comprising:

a plurality of individual items which are packages products which include food components for a single meal;

a vertically oriented spine panel positioned between at least some of said individual items;

a horizontally oriented bottom panel which depends from and is perpendicular to said spine panel;

a handle member secured to and extending beyond said spine panel;

a plurality of bands which releasably secure said plurality of individual items into a bundle of items, which bundle is thereby secured to said spine panel, one said band being on one side of said handle member and another said band being on another side of said handle member; and an upstanding projection on each edge portion of the spine panel and a passageway defined between said handle member and each said upstanding projection, and one of said bands passes through one said passage while another of said bands passes through another said passage.

8. The carrier tray assembly in accordance with claim 7, wherein said handle member is integral with said spine panel, and further including a fold line along which said handle member can fold over onto the bundle.

9. The carrier tray assembly in accordance with claim 7, wherein said plurality of bands are generally narrow bands.

10. The carrier tray assembly in accordance with claim 7, wherein said handle member extends upwardly from said spine panel.

11. The carrier tray assembly in accordance with claim 7, further including at least two adhesive areas securing said spine panel to at least two of said individual items.

* * * * *